United States Patent [19]

Kirkwood et al.

[11] 3,943,878

[45] Mar. 16, 1976

[54] POWER STEERING SYSTEM FOR BOATS

[76] Inventors: Creal E. Kirkwood, Rte. 1, Box 353C, Wagoner, Okla. 74467; Veral V. Bauer, 6741 S. Birmingham, Tulsa, Okla. 74136

[22] Filed: Sept. 9, 1974

[21] Appl. No.: 497,536

[52] U.S. Cl. ..... 115/35; 114/144 R

[51] Int. Cl.[2] ..... B63H 25/42

[58] Field of Search ..... 115/35, 18 R, 18 B, 12 R; 114/144 R, 152

[56] References Cited

UNITED STATES PATENTS

| | | | |
|---|---|---|---|
| 1,872,038 | 8/1932 | Hitzler | 114/163 |
| 2,993,464 | 7/1961 | Conover | 115/18 R |
| 3,149,605 | 9/1964 | Broadwell | 115/18 R |
| 3,208,300 | 9/1965 | Morse | 114/144 R |

*Primary Examiner*—Trygve M. Blix
*Assistant Examiner*—Gregory W. O'Connor
*Attorney, Agent, or Firm*—Head, Johnson & Chafin

[57] ABSTRACT

A system for utilizing a power assit for rotating a boat motor about a vertical axis near the stern of the boat. The power assist is provided by a small rudder mounted along the center line of the motor and positioned in a vertical plane through the axis of the propeller and aft of the propeller in the slip stream. Means are provided to operate the small rudder by the apparatus that controls the rotation of the motor, the rotation of the rudder being effected prior to applying torque to rotate the motor assembly. In operating the turning control for rotating the motor assembly, there is a slack condition whereby the first movement of the control rotates the small rudder into a position whereby the moving slip stream from the propeller exerts a torque tending to rotate the motor assembly in the desired direction. If the torque is insufficient to rotate the motor, movement of the control in a continuing direction applies a torque to directly rotate the motor assembly.

4 Claims, 8 Drawing Figures

POWER STEERING SYSTEM FOR BOATS

BACKGROUND OF THE INVENTION

In the operation of boat motors such as outboard motors mounted on the backboard of a boat or the pivoted power unit of an inboard-outboard boat, mechanism that supports the motor to the boat carries a vertical axis about which the motor assembly or the power unit itself rotates. In steering the boat a rudder is not used. In place of the rudder, the entire motor assembly is turned and with it, of course, the propeller shaft is turned so that the slip stream is directed to the stern of the boat at an angle to the axis of the boat, causing the stern to be forced in one direction or the other across the axis, thereby rotating the boat and heading the bow in a desired direction.

Physically rotating the motor assembly is arduous, especially with larger size motors, and this invention is adapted to provide an assisting torque to rotate the motor assembly by using the slip stream of the propeller to exert a force on a small rudder positioned to the rear of the propeller.

SUMMARY OF THE INVENTION

It is a primary object of this invention to provide a simple rudder and control means, whereby by turning the rudder in the slip stream of the propeller a torque is exerted on the motor assembly tending to rotate the motor assembly about its axis.

It is a further object to control the rudder rotation by the same lever that operates to directly rotate the motor assembly.

The preliminary operation of the rudder is such as to expose one side or the other of the rudder to the moving slip stream set up by the propeller. This applies a torque about the axis of rotation of the motor assembly thereby causing the motor assembly to be rotated, or at least to be assisted in its rotation, by the force of the slip stream on the rudder.

DESCRIPTION OF THE DRAWINGS

These and other objects and advantages of this invention and a better understanding of the principles and details of the invention will be evident from the following description, taken in conjunction with the appended drawings, in which.

DESCRIPTION OF THE PREFERRED EMBODIMENT

Figure 1:
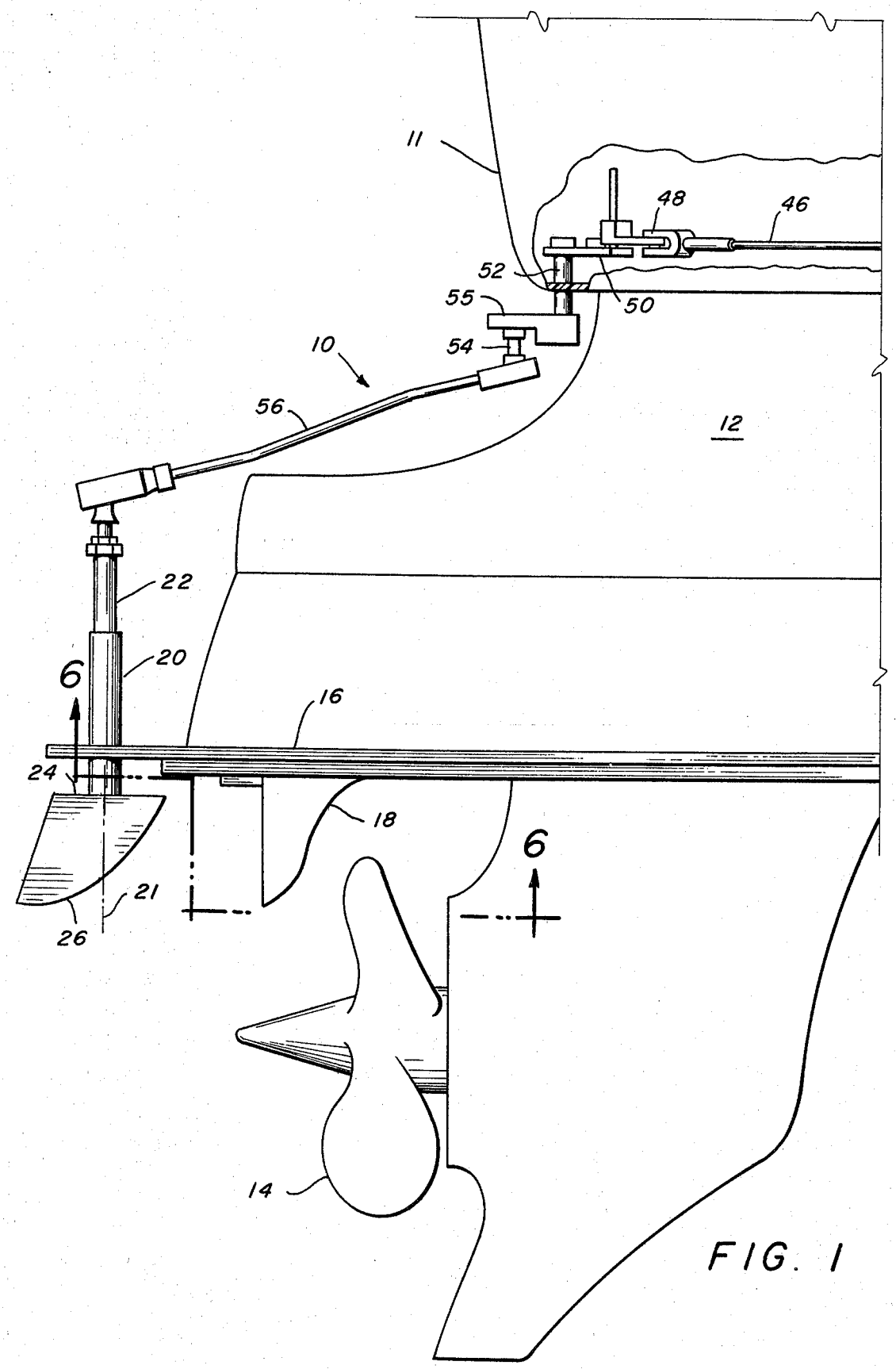
FIGS. 1 and 2 represent respectively elevation and plan views of an outboard motor assembly.
Figure 3:
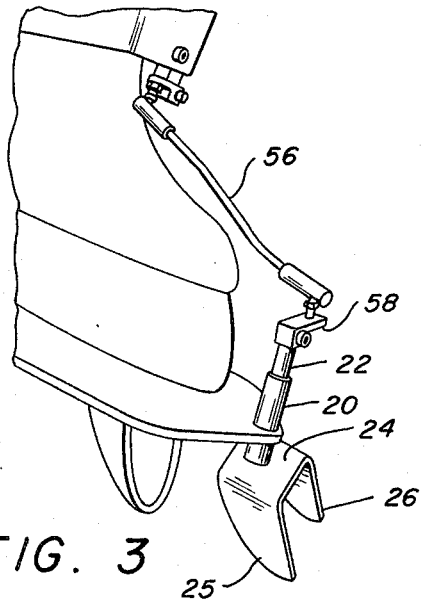
FIG. 3 illustrates a third view of a portion of the motor assembly including the additional apparatus of this invention.
Figure 2:
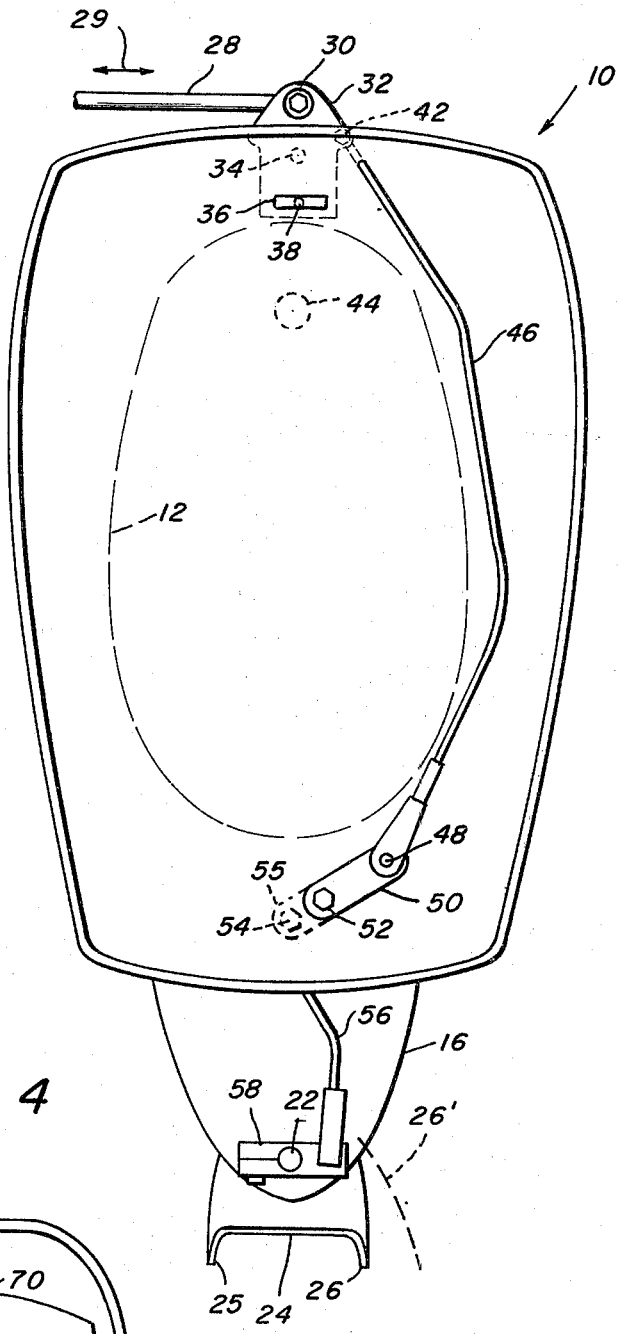

Referring now to the drawings and in particular to FIGS. 1, 2 and 3 there is shown an elevation view in FIG. 1 of a more or less standard outboard motor assembly indicated generally by the numeral 10. This includes a motor section 12 and an upper housing portion 11 with a propeller 14. Not shown are the drive shafts and gears, etc. which are well known in the art. The anti-cavitation panel 16 is a horizontal plate mounted about the propeller and extending towards the rear thereof. At the aft end of the panel 16 is a tubular member 20 serving as an axis of rotation for a rod 22 journalled in the tube 20. The rod 22 carries a small rudder 24 having two downwardly depending parallel wings 25 and 26, although it is understood that this is by way of example only in that one, two, three or more wings may be employed. The shape of the rudder is such that the major area of the wings is displaced behind the axis 21 of rotation of the rudder.

Figure 4:
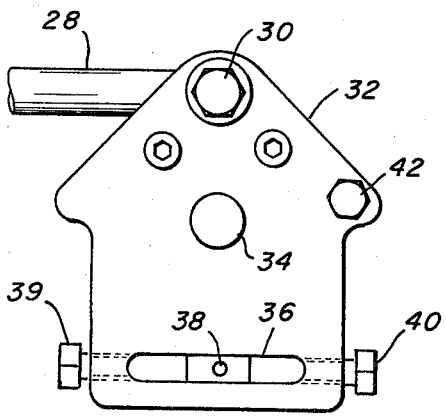
FIG. 4 illustrates a detail of the control mechanism.

As will be seen in FIG. 2 the axis of rotation of the motor assembly is indicated by the dashed circle 44. A control lever 28 is shown linked to an axis 30 on a rotatable link 32 which rotates about an axis 34 attached to the motor assembly. There is a pin 38 attached to the motor assembly which slides in a slot 36, so that by pushing or pulling on the rod 28 in the directions of the arrow 29, the plate 32 can rotate through a small angle depending upon the length of the slot 36. This is shown in greater detail in FIG. 4. Threaded holes and screws 39 and 40 are shown in the ends of the slot 36. Screws 39 and 40 can be screwed into the plate 32 and locked therein. By this means the free space for movement of the pin 38 in the slot 36 can be adjusted as desired. By pushing on the control rod 28 to the right the plate 32 will rotate until the screw 40 presses in the pin 38 and the plate 32 cannot rotate any further. Further force to the right on the rod 28 will then cause a torque to be exerted on the motor assembly about the axis of rotation 44, which will rotate the motor assembly in a clockwise direction so that the propeller will move to the left. A contrary force (on the left) on the rod 28 will cause the rotation of the motor assembly in the opposite (counterclockwise) direction.

It is desired to provide an assisting force so that by pushing on the rod 28 the assist force will become effective before the play is taken up between the pin 38 and the screws 39 and 40, which limit the length of the slot 36. There is a bolt 42 about which the rod 46 can rotate. The rod 46 is connected at its aft end to a pin 48 in a lever 50, which rotates about a vertical axle 52. As shown more clearly in FIG. 1 this axle 52 connects to an arm 55, which is pivoted by means 54 to a second rod 56, which is pivoted to another arm 58, which is clamped to the vertical rod 22 which controls the position of the rudder 24. By pushing to the right on the lever 28 the plate 32 is caused to rotate pushing the rod 46 to the rear and by means of links 54, 55, 56 and 58 causing a counterclockwise rotation of the rudder 24 to the dashed position shown as 26'.

Figure 6:
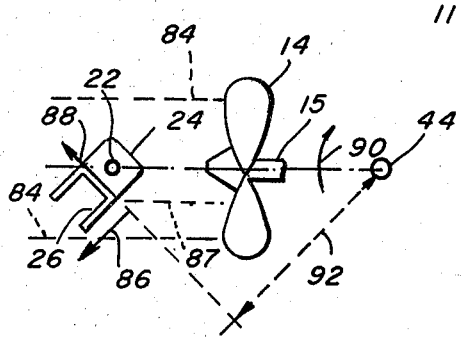
FIG. 6 indicates schematically the action of the improvement of this invention.

Referring now to FIG. 6, which is a schematic view of the propeller 14 on the propeller shaft 15 creating a slip stream indicated by the dashed line 84. Aft of the propeller and on a vertical plane through the axis of the propeller is the rod 22 which supports the rudder 24 and which is rotatably mounted in the bearing 20. When the rudder is turned to the position shown which corresponds to the dashed position 26' of one of the two depending arms of the rudder, it will be seen that the slip stream element 87 strikes the side wall of the leg 26, causing a tangential force 86 and a perpendicular force 88 to be applied to the rudder. This force 88 acting through the arm 92 around the axis of rotation 44 of the motor assembly, tends to rotate the entire apparatus about the axis 44 in accordance with arrow 90.

The magnitude of the force 88 and therefore of the torque to rotate the motor assembly depends upon the position of the rudder with respect to the propeller and the area of the legs 26, 25, for example and the speed of rotation of the propeller and therefore the velocity of the slip stream. At high speed it is likely that there will be sufficient torque to rotate the motor assembly supplied only by the force of the slip stream on the rudder. In this design the rudder comprises two parallel rudder surfaces, which provide an increased force and therefore an increased torque to rotate the motor assembly.

The play provided in the slot 36 should be such that the rudder 24 can be turned to its maximum angle, which is shown to be approximately 30°. In this position the perpendicular force 88 will be at an angle that it will supply a sizable torque around the axis 44. Then pushing on the control 28 to the right will cause full excursion of the rudder before the force exerted by control 28 becomes effective on the motor assembly itself, due to the plate 32 driving against the pin 38. Therefore at high speed of rotation where the assisting force on the rudder can do the entire job, all that is necessary by forcing the control 28 to the right, is to rotate the rudder and the rotation of the motor assembly will follow the movement of the control 28 without any extra force being exerted to directly rotate the motor assembly manually.

At low speeds and low slip stream velocities it may be that there will be insufficient torque to rotate the motor assembly entirely alone and, therefore, the torque provided will only assist the manual rotation which will be effected by pushing the control 28 to the right until the plate 32 is locked against the pin 38 and further force on 28 will cause a torque to rotate the motor assembly directly.

Figure 5:
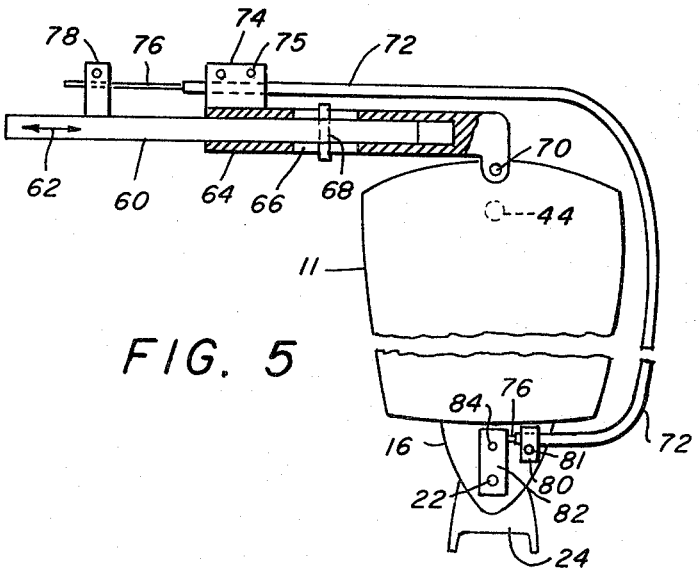
FIG. 5 illustrates a second embodiment of the invention using a "push-pull" cable as the control means.

Referring now to FIG. 5, another embodiment of this apparatus is shown in a schematic diagram. There is an arm 60 which has a slide fit into a tubular member 64. There is a slot 66 cut into the member 64 and a pin 68 passed through the member 60 so as to provide a limited motion in the direction of arrows 62, inwardly or outwardly in the member 64. The member 64 is attached by bolt means 70 to the leading portion of the motor assembly 11 which is adapted to rotate (not shown) about the axis 44, which is well known in the art. Pressure on the rod 60 until the pin 68 hits the right end of the slot 66 and further pressure on the member 60 will cause the motor assembly to rotate clockwise about the axis 44. With the member 60 positioned with its pin 68 in the center of the slot, a "push-pull" operating member 72 is clamped with its casing in a clamp 74 attached to the member 64 and with the internal rod 76 clamped by member 78 attached to the operating member 60. Pushing to the right on the member 60 will cause the internal rod to slide to the right inside the casing 72.

The other end of the casing 72 is clamped by means 80 to the plate 16 of the motor assembly. The internal rod 76 is clamped by means 84 to the arm 82 which is supported on the vertical shaft 22 attached to the rudder 24. It is clear that a relative movement to the right of the rod 76 will cause a movement to the left of the arm 82 and cause the rudder 24 to rotate in a counterclockwise direction into the position 26' shown in FIG. 2. In this position the slip stream of the propeller moving backwardly in a direction parallel to the axis of the propeller will cause a torque of the motor assembly about its axis 44 in a clockwise direction.

In a similar way a movement to the left of the member 60 will cause a rotation of the rudder in a clockwise direction, which will then put a torque on the motor assembly causing it to move in a counterclockwise direction. The play permitted between the pin 68 and the ends of the slot 66 is sufficient so that in the normal course of events the torque provided by the rudder will be enough to rotate the motor assembly so that there will be only a small torque required to move the member 60 either to the right or to the left, the principal torque for rotating the motor assembly being provided by the slip stream on the rudder.

Figure 7:
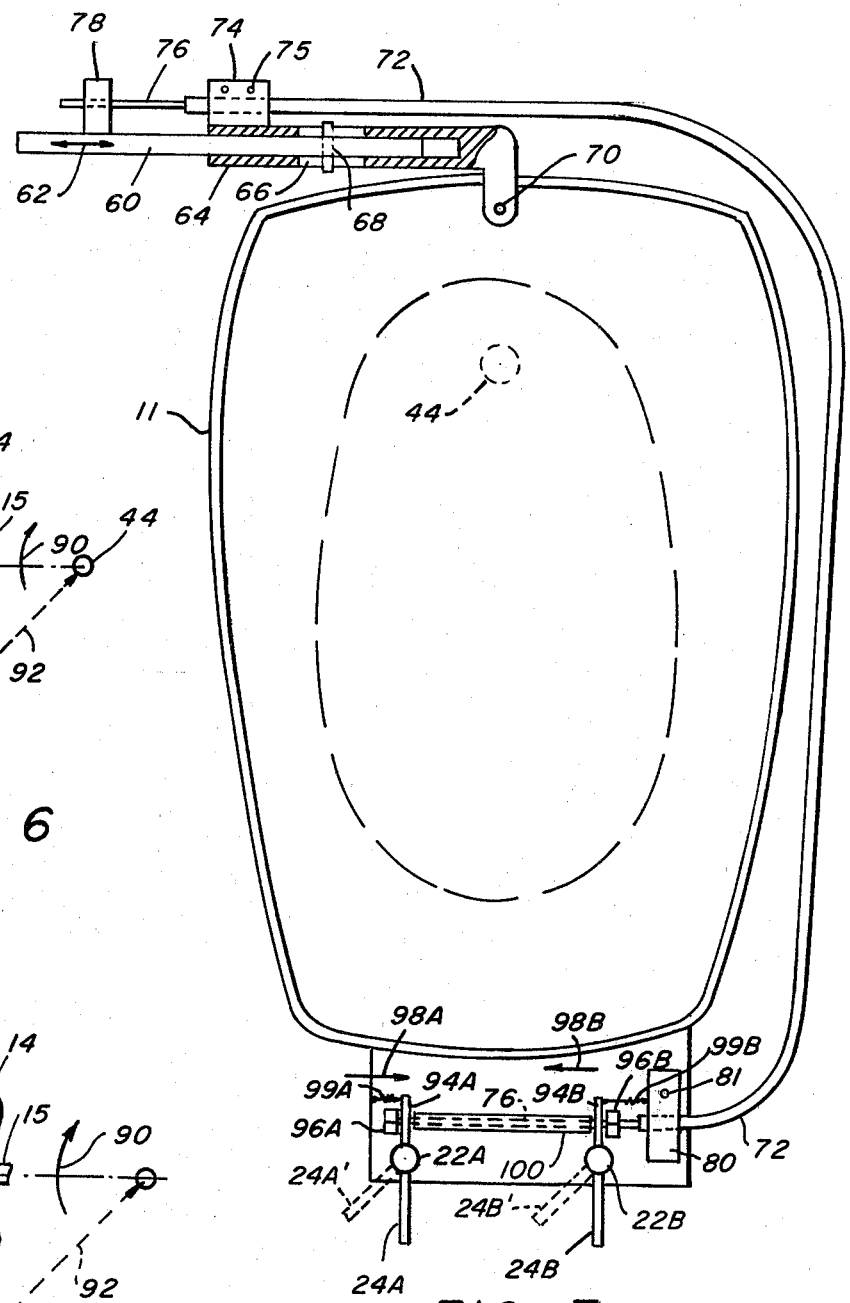
FIG. 7 illustrates another embodiment of this invention using two small rudders.

Referring now to FIG. 7 there is shown a preferred embodiment of this invention. This has the same operating member 60, push-pull rod 76 and sheath 72 as in FIG. 5. However, there are shown two rudders 24A, 24B. These are placed in positions displaced to the left and right of the axis of the propeller 14 in such positions where they are in the strongest part of the slip stream of the propeller. There are drilled holes through the levers 94A, 94B attached to the rudder posts 22A, 22B, through which the rod 76 passes. Collars 96A, 96B are attached to the rod 76. A tube 100 is received on the rod 76 between the levers 94A and 94B.

It will be clear, that when the rod 76 moves to the left in accordance with arrow 98B, the collar 96B presses on the arm 94B and turns the rudders to the position 24B'. Spring means 99A, 99B are provided to return the rudders to their position parallel to the axis of the propeller after the rod moves to its central position shown in FIG. 7.

When the rod 76 moves to the right in accordance with arrow 98A the collar 96A presses on the rudder arm 94A to turn the rudders in a clockwise direction. The movement of rod 76 to the right moves by action of switch 160 rudder 24B, and in similar manner the movement to the left affects rudder 24A.

Figure 8:
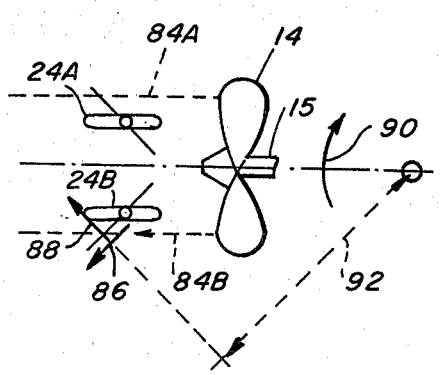
FIG. 8 illustrates the action of the embodiment of FIG. 7.

The situation when the rudders 24A or 24B are turned is shown in FIG. 8. The slip stream element 84B acting on the turned rudder 24B creates a tangential force 86 and a perpendicular force 88. The force 88 acting through the arm 92 causes a torque tending to rotate the motor assembly in the direction 90. If the rudder 24A is turned to position 24A', then a reverse torque is provided tending to rotate the motor assembly in a direction opposite to arrow 90.

The turning rudder or wing of this invention works like a trim tab in that it utilizes the force of flow of water from the propeller to orient the motor or power unit. The apparatus may be used in place of the trim tab commonly installed on outboard motors and inboard-outboard power units to compensate for rotation of the propeller. The wings 25 and 26 (when two are used as illustrated, or when one, three or more are used) become, in effect, automatic trim tabs to orient the motor or power unit in the direction desired by the driver with a very minimum steering force required.

The apparatus is easy to apply, particularly the embodiment of FIG. 5. It is an important safety feature as it permits quicker and easier driving control, especially when used with larger motors and at higher speeds.

While the invention has been described with a certain degree of particularity, it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed:

1. Power steering system for outboard motors or inboard-outboard power units, comprising:

a. a motor assembly having a power shaft and gears driving a propeller mounted on a horizontal rearward extending shaft, the motor assembly adapted for rotation about a hinge means having a vertical axis, said axis of rotation on the side of said motor assembly opposite to that of said propeller, said hinge means being adapted to be clamped to the stern of a boat;

b. at least one control rudder means mounted on a vertical axis aft of said propeller and positioned in the slip stream of said propeller;

c. a tubular socket attached to the forward portion of said motor assembly, the socket having a longitudinal slot therein;

d. a cylindrical elongated arm means slidably received in said socket, the arm means being actuatable by a user;

e. a pin affixed to said arm means slidably received in said slot in said socket providing limited movement of said arm means before guiding force is applied to said socket and thereby said motor assembly; and f. means coupling said arm means to said control rudder means;

whereby when said arm means is pushed in one direction it will cause said rudder to rotate counterclockwise with respect to said motor assembly, whereby force of the slip stream on said rudder will cause torque to be applied to said motor assembly to rotate said motor assembly in a clockwise direction and vice versa.

2. A power steering system according to claim 1 wherein said means coupling said arm means to said control rudder means includes multiple rigid linkage means.

3. A power steering system according to claim 1 wherein said means coupling said arm means to said control rudder means includes a flexible cable longitudinally slidable in a tubular sheath.

4. A power steering system for outboard motors or inboard-outboard power units according to claim 1 wherein said control rudder means includes two spaced control rudders each mounted on a vertical axis aft of and one on each side of said propeller and including:

a rod extending between said rudders;

a first and second collar on said rod, one being outside of each of said rudders; and a tube received by said rod between said rudders, said means coupling said arm means to said control rudder being coupled to said rod.

* * * * *